US005731560A

United States Patent [19]

Nebon et al.

[11] Patent Number: 5,731,560

[45] Date of Patent: Mar. 24, 1998

[54] OPERATING MECHANISM OF A CIRCUIT BREAKER WITH A LOCKING SYSTEM DISENGAGEABLE ON A SHORT CIRCUIT

[75] Inventors: Jean-Pierre Nebon, Le Vinoux; Claude Grelier, Grenoble; Marc Rival, Virieu/Bourbre; Eric Pinero, Seyssinet, all of France

[73] Assignee: Schneider Electric SA, France

[21] Appl. No.: 787,268

[22] Filed: Jan. 24, 1997

[30] Foreign Application Priority Data

Feb. 6, 1996 [FR] France ..... 96 01661

[51] Int. Cl.[6] ..... H01H 77/10

[52] U.S. Cl. ..... 218/22; 335/147; 335/167; 335/172

[58] Field of Search ..... 218/1, 22, 23, 218/29–37, 40–42, 154; 335/2, 6, 8, 9, 10, 15, 16, 21–23, 46, 167–173, 185, 186, 203, 195, 147

[56] References Cited

U.S. PATENT DOCUMENTS

| | | | |
|---|---|---|---|
| 3,873,950 | 3/1975 | Guschin | 335/42 |
| 4,281,303 | 7/1981 | Heft | 335/16 |
| 4,639,701 | 1/1987 | Shimp | 335/21 |
| 4,713,508 | 12/1987 | Baginski et al. | 200/153 SC |
| 4,791,250 | 12/1988 | Yin | 200/17 R |
| 4,906,967 | 3/1990 | Winter | 335/172 |

FOREIGN PATENT DOCUMENTS

| | | | |
|---|---|---|---|
| 0466287 | 1/1992 | European Pat. Off. | H01H 71/10 |

*Primary Examiner*—Michael L. Gellner
*Assistant Examiner*—Michael A. Friedhofer
*Attorney, Agent, or Firm*—Parkhurst, Wendel & Burr, L.L.P.

[57] ABSTRACT

A mechanism for a multipole circuit breaker with high currents and high electrodynamic strength, comprising a toggle device associated to a trip hook and a switching bar, an opening ratchet cooperating with the hook to perform loading and tripping of the mechanism respectively in the locked or unlocked position of the ratchet. The opening ratchet comprises a disengageable actuator causing self-unlocking of the catch in the presence of a short-circuit current exceeding a calibration threshold defined by a flexible element, said self-unlocking being commanded from a mechanical reaction generated by the electrodynamic compensation effect and causing an ultra-fast rotation of the catch to unlock the opening ratchet before the tripping component operates.

7 Claims, 4 Drawing Sheets

OPERATING MECHANISM OF A CIRCUIT BREAKER WITH A LOCKING SYSTEM DISENGAGEABLE ON A SHORT CIRCUIT

BACKGROUND OF THE INVENTION

The invention relates to an operating mechanism of a low voltage multipole circuit breaker with high electrodynamic strength, comprising an electrical power circuit having per pole a pair of compensated contacts kept in the closed position by electrodynamic compensation effect of the repulsion forces, said mechanism being supported by a frame and comprising:

- a toggle device associated to a trip hook and to an opening spring to move the movable contact to an open position when the hook is actuated from a loaded position to a tripped position,
- a switching bar made of insulating material coupled to the toggle device and extending transversely to the frame, and comprising a rotary shaft supporting the movable contacts of all the poles,
- an opening ratchet cooperating with the trip hook to perform loading or tripping of the mechanism respectively in the locked or unlocked position of said ratchet,
- and a catch controlled by a tripping component to actuate the opening ratchet to the unlocked position.

A mechanism of the kind referred to is described in the document EP-A-222,645 filed by the applicant. The electrodynamic strength of the circuit breaker results from the action of the contact pressure springs on the multiple fingers, and of the compensated contacts, whose articulation spindle is subjected to high mechanical reactions. The mechanism is able to withstand these reactions for a maximum short-circuit current threshold. Above this threshold, the reactions are liable to damage certain spindles or transmission components of the mechanism, and are liable to increase the tripping force at the level of the stage comprising the hook, opening ratchet and catch. Operation of the instantaneous trip device requires a response time of about 10 ms to achieve tripping of the mechanism, which is too long, if the performances of the circuit breaker have to satisfy a high electrodynamic strength and a breaking capacity greater than 130 kA.

It has already been proposed (see document FR-A-2,239,755) to use the mechanical reaction resulting from electrodynamic repulsion of the compensated contacts to bring about automatic tripping, which takes place by a locking part being released from the half-moon which remains fixed. The reinitialization phase after tripping on a short-circuit of such a mechanism is difficult to implement.

SUMMARY OF THE INVENTION

The object of the invention is to achieve a circuit breaker with a high electrodynamic strength and a high breaking capacity, requiring a low tripping force and a short tripping time when a large short-circuit current occurs.

The mechanism according to the invention is characterized in that the opening ratchet comprises disengageable actuating means causing self-unlocking of the catch in the presence of a short-circuit current exceeding a calibration threshold defined by flexible means, said self-unlocking being commanded from a mechanical reaction generated by the electrodynamic compensation effect and causing an ultra-fast rotation of the catch to unlock the opening ratchet before the tripping component operates.

According to a feature of the invention, the opening ratchet comprises a holding lever equipped with a nose designed to latch with the catch in the locked position and at least one support flange of a roller cooperating with a bearing surface of the trip hook, said flexible means being arranged between the holding lever and the flange allowing a relative movement suitable for self-unlocking of the catch after the calibration threshold has been exceeded.

According to a preferred embodiment, the holding lever is articulated on the pivoting spindle of the opening ratchet, the flange comprising an operating ramp designed to make the catch rotate to achieve said self-unlocking.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DETAILED DESCRIPTION OF THE PREFERRED EMBODIMENT

Figure 1:
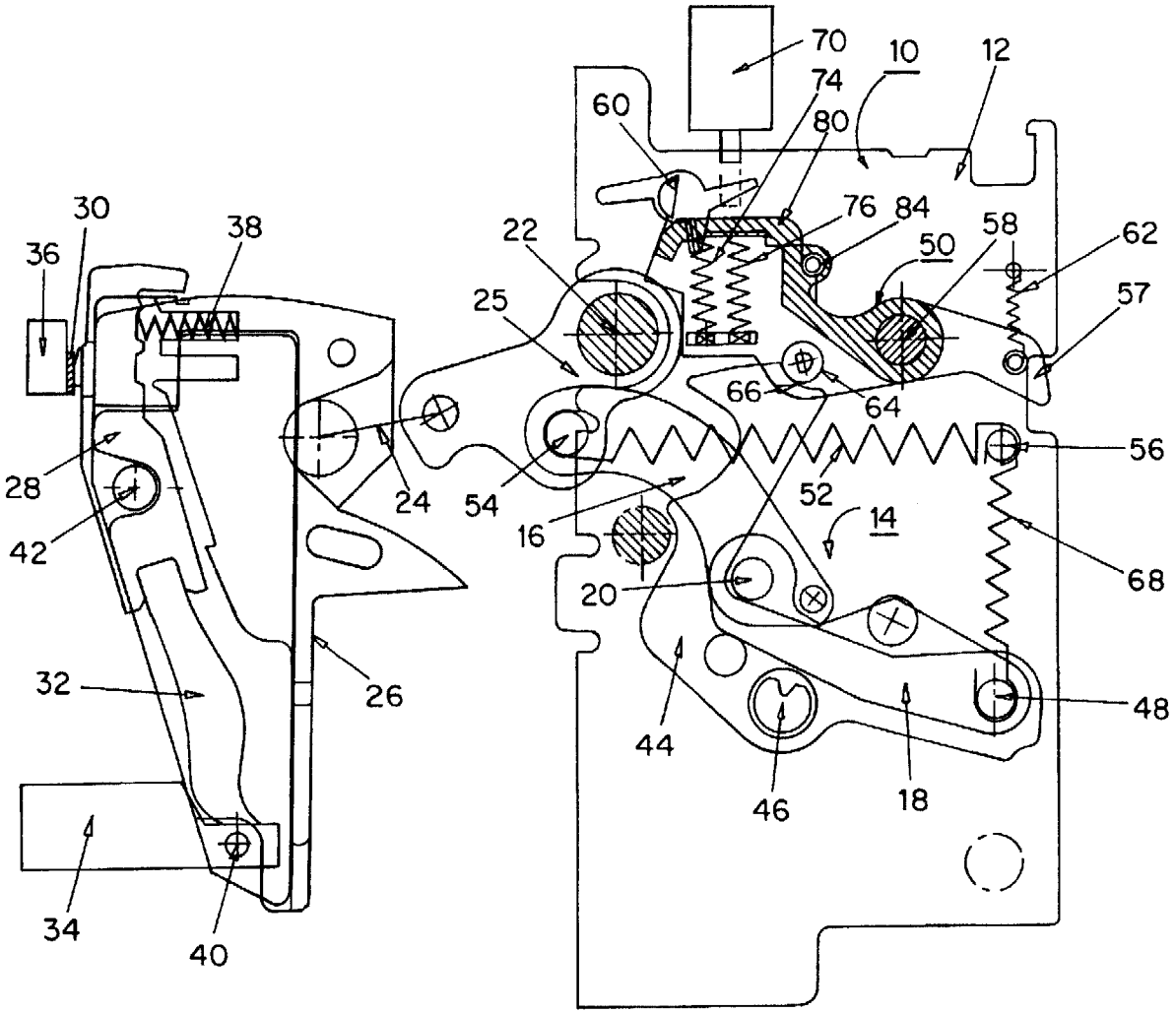
FIG. 1 is a schematic view of the mechanism equipped with the opening ratchet according to the invention, the contacts being represented in the closed position.
Figure 2:
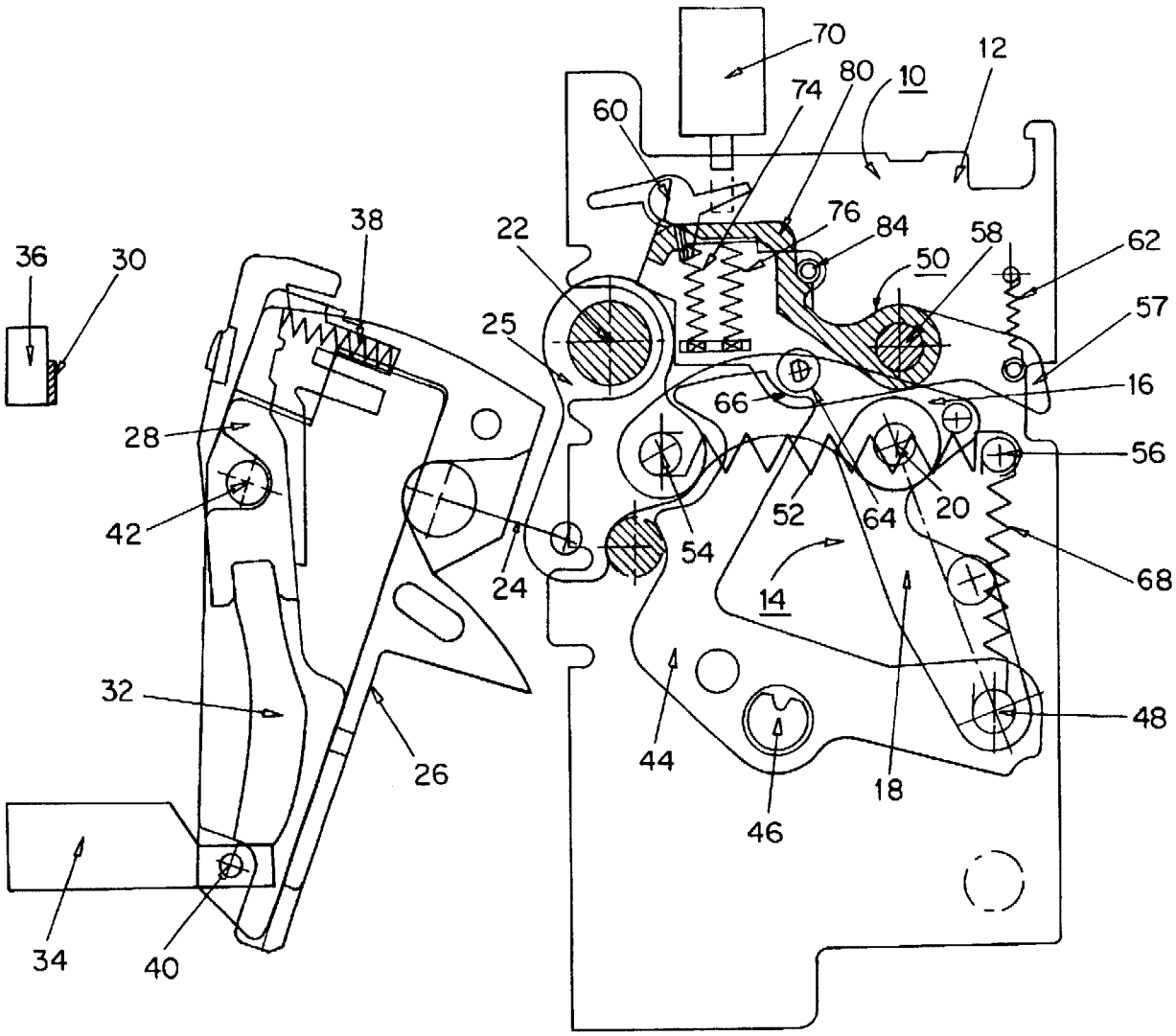
FIG. 2 is an identical view to FIG. 1 representing the mechanism in the open position of the contacts.

With reference to FIGS. 1 and 2, an operating mechanism 10 of a multipole circuit breaker is supported by a frame 12 and comprises a toggle device 14 having a pair of transmission rods 16, 18 articulated on a pivoting spindle 20. The lower rod 16 is mechanically coupled to a switching bar 22 made of insulating material extending perpendicularly to the flanges of the frame 12. The switching bar 22 is common to all the poles and is formed by a shaft mounted in rotation between an open position and a closed position of the circuit breaker contacts. The circuit breaker is of the strong current type with a high electrodynamic strength.

At the level of each pole there is arranged a connecting rod system 24 which connects a crank 25 of the bar 22 to an insulating cage 26 supporting the movable contact 28. The movable contact 28 cooperates with a stationary contact 30 in the closed position and is connected by a braided strip 32 to a first connection pad 34. The stationary contact 30 is directly supported by the second connection pad 36. A contact pressure spring 38 is arranged between the cage 26 and the upper face of each movable contact 28.

The cage 26 is mounted with pivoting around a first spindle 40 between the closed position and the open position, and the movable contact 28 comprises a plurality of parallel fingers articulated on a second spindle 42 of the cage 26.

There is associated to the toggle device 14 a trip hook 44 mounted with limited rocking on a main spindle 46 between a loaded position and a tripped position. The main spindle 46 is securedly united to the frame 12 and one of the ends of the hook 44 is articulated on the upper rod 18 by a spindle 48, whereas the other opposite end cooperates with an opening catch 50.

An opening spring 52 is secured between a spigot 54 of the bar 22 and a fixed lug 56 of the frame 12, said lug 56 being located above the toggle device 14. The opening ratchet 50 is formed by a locking lever 57 pivotally mounted on a spindle 58 between a locked position and an unlocked position. A catch 60 in the shape of a half-moon is able to move the opening ratchet 50 to the unlocked position to bring about tripping of the mechanism 10.

A return spring 62 of the opening ratchet 50 is located opposite the catch 60 with respect to the spindle 58 and biases the opening ratchet 50 counterclockwise to the locked position. A roller 64 is arranged on the locking lever 57 between the spindle 58 and the catch 60 and cooperates in the loaded position with a bearing surface 66 of the trip hook 44. The bearing surface 66 of the hook 44 presents a recess in which the cylindrical roller 64 engages. A return spring 68 is secured between the spindle 48 and the lug 56 to bias the hook 44 counterclockwise to the loaded position, in which the roller 64 of the opening ratchet 50 is engaged in the recess of the bearing surface 66.

The catch 60 of the opening ratchet 50 is controlled by a tripping component 70 to move the locking lever 57 to the unlocked position, resulting in tripping of the mechanism 10 and opening of the contacts 28, 30. The tripping component 70 can be actuated manually, notably by means of a push-button, or automatically, notably by a magnetothermal or electronic trip device, or by a shunt release sensitive to a remote control signal.

According to the invention, the opening ratchet 50 is arranged as a disengageable assembly enabling self-unlocking of the catch 60 in the presence of a short-circuit current exceeding a preset threshold henceforth called the disengagement threshold.

The contacts 28, 30 and pads 34, 36 form a U-shaped circuit, the second articulation spindle 42 of the fingers of the movable contact 28 being situated at one third of the distance separating the two pads 34, 36. The structure of such a circuit constitutes a compensation system of the electrodynamic repulsion forces liable to keep the contacts closed in the presence of a short-circuit current, until tripping of the mechanism 10 occurs brought about by the tripping component 70.

Figure 3:
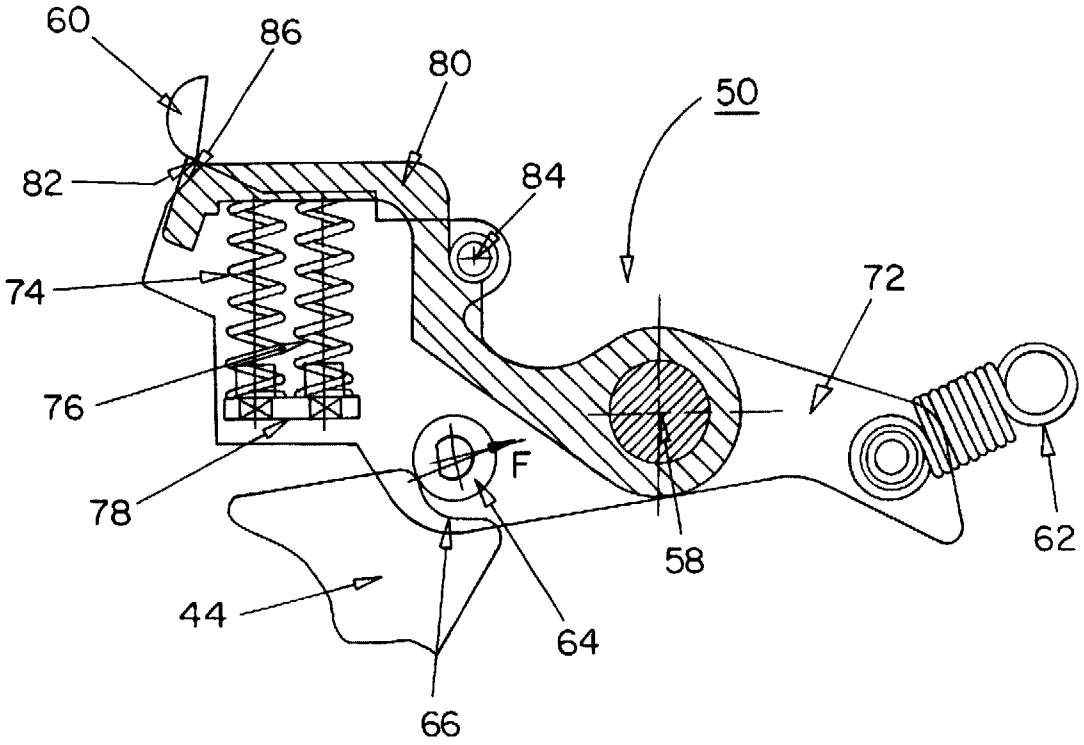
FIG. 3 shows the opening ratchet of FIG. 1 in the locked position.
Figure 4:
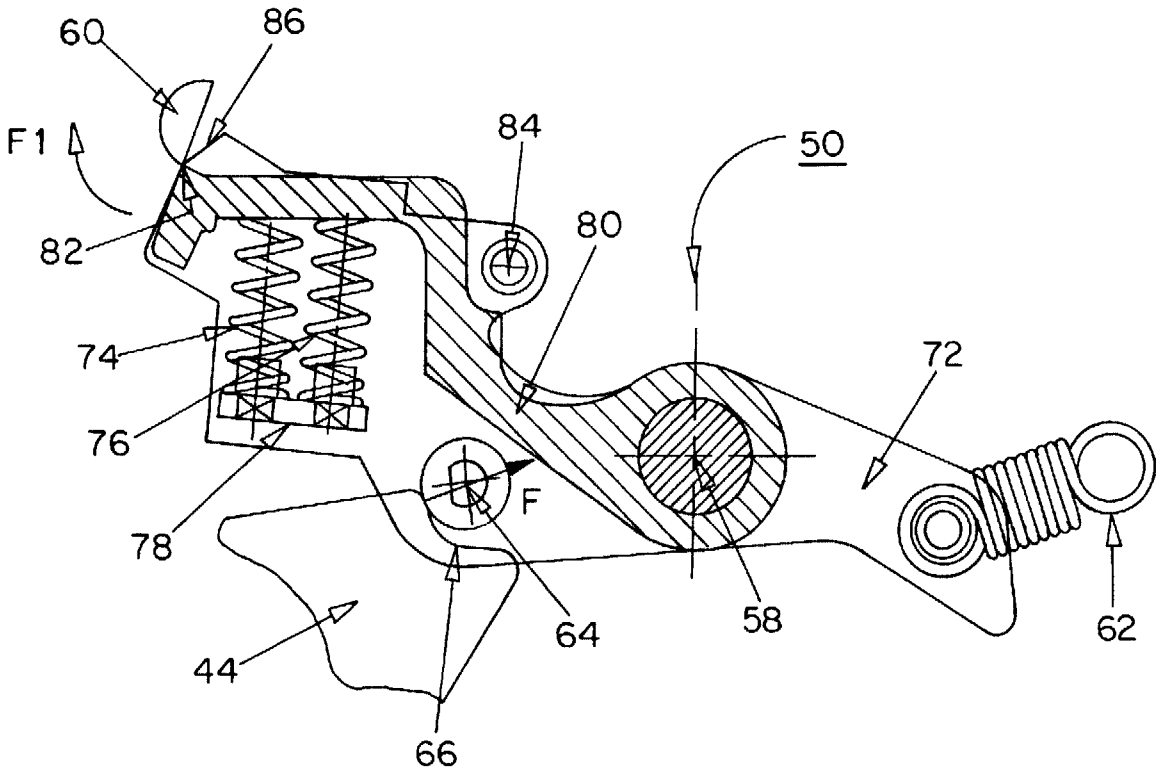
FIG. 4 is an identical view of the ratchet of FIG. 3 in the self-unlocking phase of the catch.

With reference to FIGS. 3 and 4, the opening ratchet 50 comprise a pair of flanges 72 supporting the spindle 58 and the roller 64 mounted with free rotation. The disengagement threshold is calibrated by means of two compression springs 74, 76, arranged between a guide plate 78 securedly united to the flanges 72, and a holding lever 80 articulated on the spindle 58. The end of the holding lever 80 is provide with a nose 82 designed to latch with the catch 60 in the locked position of the ratchet 50.

An end of travel stop 84 is securedly united to the flanges 72 and is designed to limit the pivoting movement of the ratchet 50 in the unlocked position. Each flange 72 comprises an operating ramp 86 located close to the nose 82 of the holding lever 80, the inclination of the ramp 86 being chosen to bring about self-unlocking of the catch 60 when the calibration threshold of the springs 74, 76 is exceeded.

The operation of the mechanism 10 equipped with the disengageable opening ratchet 50 according to the invention is as follows:

In the closing phase of the mechanism 10, the bearing surface 66 of the trip hook 44 exerts a force F on the roller 64, and biases the opening ratchet 50 in clockwise rotation around the spindle 58 until the nose 82 latches on the catch 60. The circuit breaker is then in a stable position in which the contacts 30, 28 are closed.

The circuit breaker presents a high electrodynamic strength due to the electrodynamic compensation effect which tends to keep the contacts closed in the presence of an overload current. This electrodynamic compensation effect results from the U-shaped structure of the electrical power circuit, the second articulation spindle 42 of the fingers of the movable contact 28 being advantageously situated at one third of the distance separating the two connection pads 34, 36 of the U-shaped electrical circuit. This results in a torque which urges the contacts 28, 30 to be kept in the closed position in spite of the opposing striction forces.

The increase of the contact pressure by electrodynamic effect results in a mechanical reaction, exerted on the spindle 42 of the cage 26, and transmitted to the mechanism 10 and finally exerted on the roller 64 by means of the trip hook 44.

This increase of the force F on the roller 64 depends on the intensity of the current flowing in the electrical power circuit, and tends to make the opening ratchet 50 rotate clockwise when the force F is greater than the calibration threshold of the ratchet 50, which is defined by the springs 74, 76.

At the beginning of the rotational movement of the opening ratchet, the nose 82 of the holding lever 80 remains in engagement with the catch 60, but the flanges 72 of the ratchet 50 start turning clockwise around the spindle 58. From a calibrated force corresponding to the self-unlocking threshold of the catch 60, the ramps 86 of the flanges 72 of the ratchet 50 cooperage with the half-moon of the catch 60 and cause its clockwise rotation in the direction F1, so as to release the holding nose 80, resulting in movement of the opening ratchet to the unlocked position (FIG. 4). The roller 64 being released also frees the trip hook 44, which causes opening of the contacts 30, 28 by the opening spring 52 associated to the toggle device 14.

Tripping of the mechanism 10 by the disengagement effect of the opening ratchet 50 is ultra-fast, and takes place before operation of the tripping component 70, which has a response time which depends on the type of magnetothermal or electronic trip device used in the circuit breaker. The presence of the opening ratchet 50 with self-disengagement of the catch 60 enables the circuit breaker to be self-protected in ultra-fast manner, while remaining compatible with the instantaneous protection of the trip device.

Ultra-fast self-unlocking of the mechanism 10 takes place for a high current level, notably greater than 180 kA peak. The opening ratchet 50 according to the invention constitutes a modular sub-assembly, which is interchangeable with a conventional opening ratchet, for example described in the document EP-A-222,645.

According to the embodiment of FIGS. 1 to 4, the relative movement between the flanges 72 and the holding lever 80 of the opening ratchet 50 is performed by a rotational movement having a small angular displacement. It is clear that this relative movement can be obtained by a translation movement by means of an oblong aperture.

We claim:

1. An operating mechanism of a low voltage multipole circuit breaker with high electrodynamic strength, comprising an electrical power circuit having per pole a pair of compensated contacts kept in a closed position by electrodynamic compensation effect of repulsion forces, said mechanism being supported by a frame and comprising:

a toggle device associated to a trip hook and to an opening spring to move a movable contact of the compensated contacts to an open position when the hook is actuated from a loaded position to a tripped position, a switching bar made of insulating material coupled to the toggle device and extending transversely to the frame, and comprising a rotary shaft supporting the movable contacts of the compensated contacts of all the poles, an opening ratchet cooperating with the trip hook to perform loading or tripping of the mechanism respectively in a locked or unlocked position of said ratchet, and a catch controlled by a tripping component to actuate the opening ratchet to the unlocked position, wherein the opening ratchet comprises disengageable actuating means causing self-unlocking of the catch due to a short-circuit current exceeding a calibration threshold defined by flexible means, said self-unlocking being commanded from a mechanical reaction generated by the electrodynamic compensation effect and causing an ultra-fast rotation of the catch to unlock the opening ratchet before the tripping component operates.

2. The operating mechanism according to claim 1, wherein the opening ratchet comprises a holding lever equipped with a nose designed to latch with the catch in the locked position, and at least one flange supporting a roller cooperating with a bearing surface of the trip hook, said flexible means being arranged between the holding lever and the flange allowing a relative movement suitable for self-unlocking of the catch after the calibration threshold has been exceeded.

3. The operating mechanism according to claim 2, wherein the holding lever is articulated on a pivoting spindle of the opening ratchet, the flange comprising an operating ramp designed to make the catch rotate to achieve said self-unlocking.

4. The operating mechanism according to claim 3, wherein the flexible means are formed by compression springs inserted between a guide plate securedly united to the flange and an internal bearing wall of the holding lever.

5. The operating mechanism according to claim 4, wherein the bearing wall of the compression springs is arranged in an intermediate zone between a pivoting spindle of the holding lever and the latching nose.

6. The operating mechanism according to claim 2, wherein the holding lever is mounted with limited translation on the flange to define said relative self-unlocking movement.

7. The operating mechanism according to claim 1, wherein a return spring biases the opening ratchet to the locked position, said spring being located opposite the catch with respect to a pivoting spindle of the opening ratchet.

* * * * *